US011103742B2

(12) United States Patent
Ray

(10) Patent No.: US 11,103,742 B2
(45) Date of Patent: Aug. 31, 2021

(54) EXERCISE APPARATUS

(71) Applicant: Volcano Strength LLC, Westerville, OH (US)

(72) Inventor: Christopher J. Ray, Westerville, OH (US)

(73) Assignee: VOLCANO STRENGTH LLC, Westerville, OH (US)

( * ) Notice: Subject to any disclaimer, the term of this patent is extended or adjusted under 35 U.S.C. 154(b) by 35 days.

(21) Appl. No.: 16/569,837

(22) Filed: Sep. 13, 2019

(65) Prior Publication Data

US 2020/0086167 A1 Mar. 19, 2020

Related U.S. Application Data

(60) Provisional application No. 62/730,630, filed on Sep. 13, 2018.

(51) Int. Cl.

| | |
|---|---|
| ***A63B 21/00*** | (2006.01) |
| ***A63B 1/00*** | (2006.01) |
| ***A63B 21/072*** | (2006.01) |

(52) U.S. Cl.

CPC ..... *A63B 21/4035* (2015.10); *A63B 1/00* (2013.01); *A63B 21/072* (2013.01)

(58) Field of Classification Search

CPC .... A63B 1/00; A63B 3/00; A63B 4/00; A63B 9/00; A63B 2009/006; A63B 17/00; A63B 17/02; A63B 17/04; A63B 21/0004; A63B 21/00047; A63B 21/06; A63B 21/0601; A63B 21/0608; A63B 21/072; A63B 21/0724; A63B 21/0726; A63B 21/075; A63B 21/29; A63B 21/285; A63B 21/4023; A63B 21/4027; A63B 21/4033; A63B 21/4035; A63B 21/4043; A63B 23/03516;

(Continued)

(56) References Cited

U.S. PATENT DOCUMENTS 3,701,529 A * 10/1972 Kruthaupt ..... A63B 21/04 482/123
D555,961 S * 11/2007 Lien ..... D6/552

(Continued)

OTHER PUBLICATIONS

Roguefitness, Y-1 Rogue Yoke Webpage, published on the internet Jun. 15, 2014.

*Primary Examiner* — Garrett K Atkinson
*Assistant Examiner* — Zachary T Moore
(74) *Attorney, Agent, or Firm* — McNees Wallace & Nurick LLC

(57) ABSTRACT

An exercise apparatus is disclosed, comprising a first frame, a second frame aligned about parallel to the first frame, and at least three crossbars extending about orthogonally between inward faces of the frames. Each of the first frame and the second frame includes at least three vertices, at least three sides extending between the at least three vertices, at least three attachment struts disposed inward from the at least three vertices, and at least three load posts extending from an outward face of the frames. The at least three sides of each frame are formed of at least three frame struts. The at least three crossbars attach to one of the at least three attachment struts of the first frame and one of the at least three attachment struts of the second frame. The load posts are arranged and disposed to receive and releasably retain a plurality of weights.

20 Claims, 6 Drawing Sheets

(58) Field of Classification Search
CPC ..... A63B 23/0355; A63B 23/03575; A63B 23/12; A63B 23/1209; A63B 23/1218; A63B 23/1227; A63B 71/02; A63B 71/023; A63B 71/04; A63B 71/0054; A63B 2071/026
See application file for complete search history.

(56) References Cited

U.S. PATENT DOCUMENTS

| | | | | |
|---|---|---|---|---|
| D806,188 | S * | 12/2017 | Petek | D21/686 |
| 2009/0211996 | A1* | 8/2009 | Webber | A47F 7/0028 211/85.7 |
| 2012/0142506 | A1* | 6/2012 | Hetrick | A63B 23/0216 482/142 |
| 2018/0243597 | A1* | 8/2018 | Schlegel | A63B 21/40 |
| 2019/0009121 | A1* | 1/2019 | Briggs | A63B 21/4027 |
| 2019/0160318 | A1* | 5/2019 | Grenae | A63B 21/0442 |

* cited by examiner

EXERCISE APPARATUS

RELATED APPLICATIONS

This application claims the benefit of and priority to U.S. Prov. App. No. 62/730,630, entitled "Apparatus For Strength Training with Yoke Exercise," filed Sep. 13, 2018, which is hereby incorporated by reference in its entirety.

FIELD OF THE INVENTION

The present application describes exercise apparatuses. More particularly, the present application describes exercise apparatuses suitable for use in both yoke carry exercises and tire flip exercises.

BACKGROUND OF THE INVENTION

Yoke carry exercises are a popular feature of strongman competitions and may be a valuable addition to a workout regimen. Advantages of the yoke carry include building strength, speed, and stability. However, the exercise apparatuses used for yoke carry exercises have numerous deficiencies, which may negatively impact both the quality of exercise experienced, and also the safety of the user. In particular, it is noted that standard yoke carry apparatuses are subject to torsional strain of the crossbar, undesirable inertial affects from movement of the apparatus during use, and instability of the apparatus generally. Further, the typical apparatus used for yoke carry exercise are bulky, and only suitable for a single type of exercise, making them inefficient from a space utilization standpoint.

Tire flipping exercises, like yoke carry exercises, are a popular feature of strongman competitions and offers many benefits for a workout regimen. However, actually flipping tires may also be problematic for a number of reasons. First, as a matter of practicality, large tires are extremely bulky, and much of that bulk is not actually incorporated usefully into the exercise, other than as a matter of weight, making the large tires typically employed space inefficient. There is also a difficulty in having enough tires of different sizes or thickness to provide a reasonably graduated training schedule. Acquiring enough tires of various weights for proper training requires a large amount of storage space, and the tires themselves, being round, are frequently at risk for taking a bad bounce, rolling, or otherwise entering into an uncontrolled state which puts nearby persons or objects at risk of damage. Also, because tires are generally not specifically designed for exercise purposes, the requirement that a person working out with a tire secure a grip with little accessible space where the tire rests on the ground, and bend over all the way to the ground, unnecessarily increases risks of injury without commensurate exercise benefits. In particular, tire flipping exercises involving a supinated grip may cause injuries of the bicep tendons, and if a user's back is rounded, the user's back may be injured.

BRIEF DESCRIPTION OF THE INVENTION

In an exemplary embodiment, an exercise apparatus comprises a first frame, a second frame aligned about parallel to the first frame, and at least three crossbars extending about orthogonally between an inward face of the first frame and an inward face of the second frame. The first frame includes at least three vertices of the first frame, at least three sides of the first frame extending between the at least three vertices of the first frame, at least three attachment struts of the first frame disposed inward from the at least three vertices of the first frame, and at least three load posts of the first frame extending from an outward face of the first frame. The at least three sides of the first frame are formed of at least three frame struts of the first frame. The second frame includes at least three vertices of the second frame, at least three sides of the second frame extending between the at least three vertices of the second frame, at least three attachment struts of the second frame disposed inward from the at least three vertices of the second frame, and at least three load posts of the second frame extending from an outward face of the second frame. The at least three sides of the second frame are formed of at least three frame struts of the second frame. The at least three crossbars attach to one of the at least three attachment struts of the first frame and one of the at least three attachment struts of the second frame. The at least three load posts of the first frame and the at least three load posts of the second frame are arranged and disposed to receive and releasably retain a plurality of weights.

BRIEF DESCRIPTION OF THE DRAWINGS

Features and advantages of the general inventive concepts will become apparent from the following description made with reference to the accompanying drawings, including drawings represented herein in the attached set of figures, of which the following is a brief description.

This disclosure describes exemplary embodiments in accordance with the general inventive concepts and is not intended to limit the scope of the invention in any way. Indeed, the invention as described in the specification is broader than and unlimited by the exemplary embodiments set forth herein, and the terms used herein have their full ordinary meaning.

DETAILED DESCRIPTION

An apparatus is provided for use in a variety of exercises, including, but not limited to, yoke carry exercises, Zercher carry exercises, and tire flipping exercises. Embodiments of the present inventions increase space efficiency, increase weight adjustability, increase sizing adjustability, improve ergonomics, increase apparatus strength, increase apparatus stability, increase apparatus durability, decrease injury risk, and combinations thereof.

As used herein, "about orthogonally" indicates within 10° of being orthogonal. As used herein, "essentially orthogonally" indicates within 5° of being orthogonal.

As used herein, "about parallel" indicates within 10° of being parallel. As used herein, "essentially parallel" indicates within 5° of being parallel.

As used herein, "releasably attached" indicates that the attachment may be undone without damage to the parts which had been previously attached.

Figure 1:
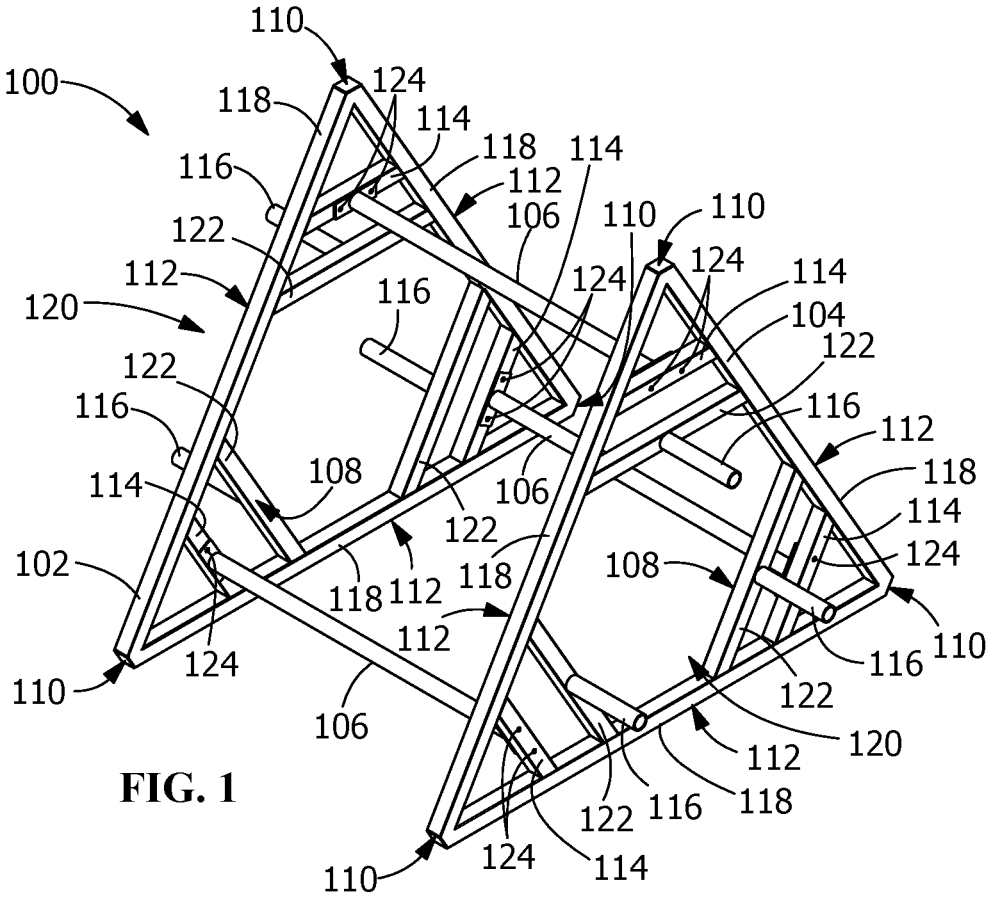
FIG. 1 is a perspective view of an exercise apparatus, according to an embodiment of the disclosure.
Figure 2:
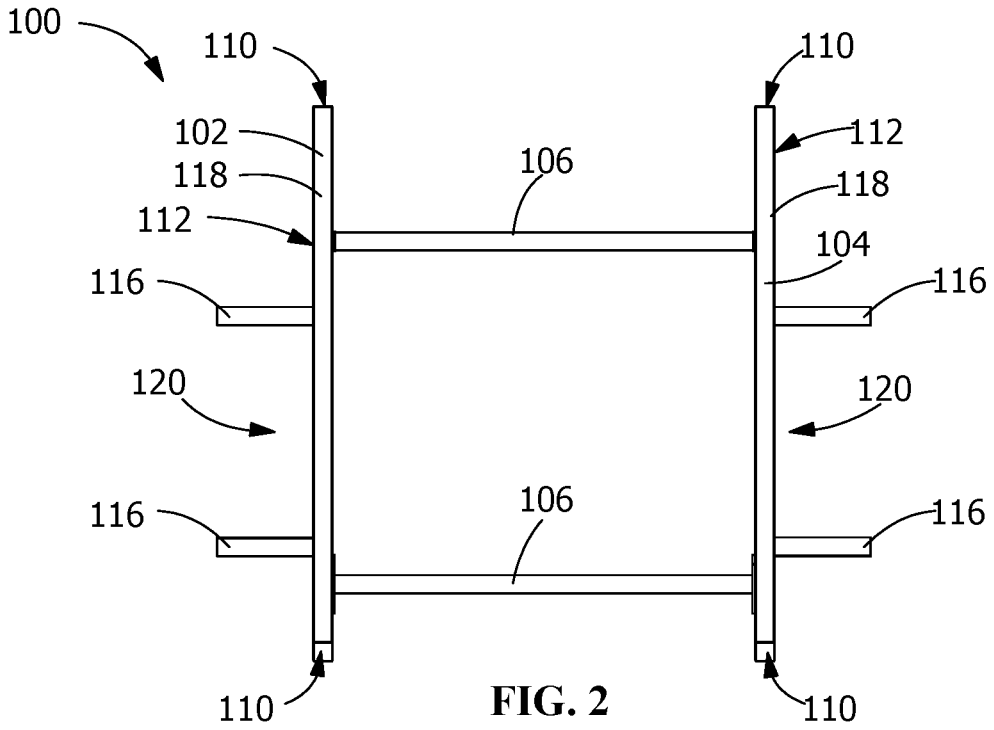
FIG. 2 is front view of the exercise apparatus of FIG. 1, according to an embodiment of the disclosure.
Figure 3:
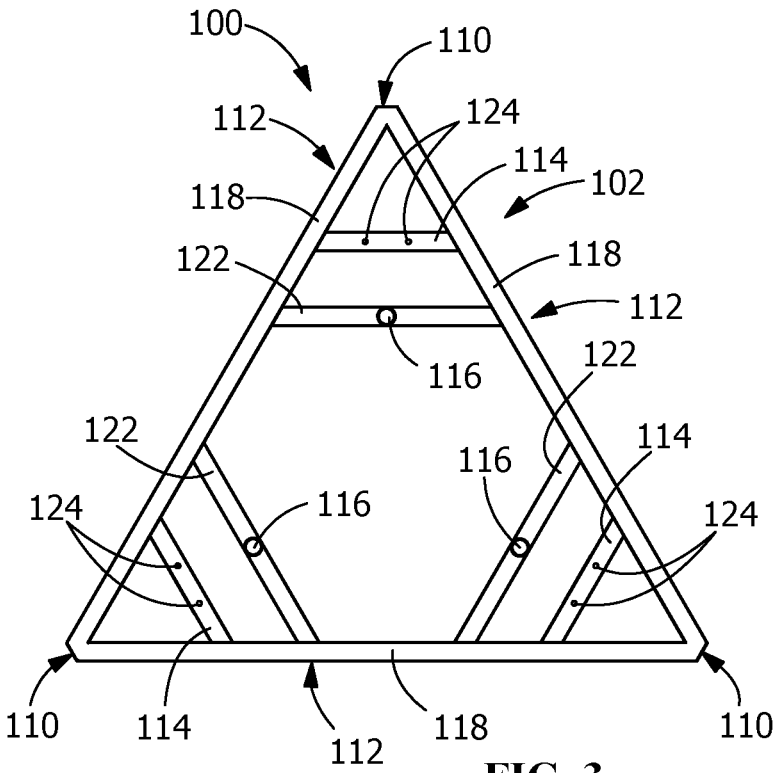
FIG. 3 is a side view of the exercise apparatus of FIG. 1, according to an embodiment of the disclosure.

Referring to FIGS. 1-3, in one embodiment, an exercise apparatus 100 comprises a first frame 102, a second frame 104 aligned about parallel, alternatively essentially parallel, alternatively parallel, to the first frame 102, at least three crossbars 106 extending about orthogonally, alternatively essentially orthogonally, alternatively orthogonally, between an inward face 108 of the first frame 102 and an inward face 108 of the second frame 104.

The first frame 102 includes at least three vertices 110 of the first frame 102, at least three sides 112 of the first frame 102 extending between the at least three vertices 110 of the first frame 102, at least three attachment struts 114 of the first frame 102, and at least three load posts 116 of the first frame 102. The at least three sides 112 of the first frame 102 are formed of at least three frame struts 118 of the first frame 102. The at least three attachment struts 114 of the first frame 102 are disposed inward from the at least three vertices 110 of the first frame 102. The at least three load posts 116 of the first frame 102 extend from an outward face 120 of the first frame 102.

The second frame 104 includes at least three vertices 110 of the second frame 104, at least three sides 112 of the second frame 104 extending between the at least three vertices 110 of the second frame 104, at least three attachment struts 114 of the second frame 104, and at least three load posts 116 of the second frame 104. The at least three sides 112 of the second frame 104 are formed of at least three frame struts 118 of the second frame 104. The at least three attachment struts 114 of the second frame 104 are disposed inward from the at least three vertices 110 of the second frame 104. The at least three load posts 116 of the second frame 104 extend from an outward face 120 of the second frame 104.

The at least three crossbars 106 attach to one of the at least three attachment struts 114 of the first frame 102 and one of the at least three attachment struts 114 of the second frame 104.

In one embodiment (FIGS. 1 and 5), the first frame 102 further includes at least three weight struts 122 of the first frame 102, the second frame 104 further includes at least three weight struts 122 of the second frame 104, the at least three load posts 116 of the first frame 102 extend from the at least three weight struts 122 of the first frame 102, and the at least three load posts 116 of the second frame 104 extend from the at least three weight struts 122 of the second frame. The at least three weight struts 122 of the first frame 102 may be disposed inward of the at least three attachment struts 114 of the first frame 102, and the at least three weight struts 122 of the second frame 104 may be disposed inward of the at least three attachment struts 114 of the second frame 104, or the at least three attachment struts 114 of the first frame 102 may be disposed inward of the at least three weight struts 122 of the first frame 102, and the at least three attachment struts 114 of the second frame 104 may be disposed inward of the at least three weight struts 122 of the second frame 104.

In a further embodiment (FIG. 1), each of the at least three attachment struts 114 of the first frame 102 is paired with one of the at least three weight struts 122 of the first frame 102 to which it is closest and to which it is about parallel, alternatively essentially parallel, alternatively parallel, and each of the at least three attachment struts 114 of the second frame 104 is paired with one of the at least three weight struts 122 of the second frame 104 to which it is closest and to which it is about parallel, alternatively essentially parallel, alternatively parallel. In an alternative further embodiment (FIG. 5), each of the at least three attachment struts 114 of the first frame 102 is paired with one of the at least three weight struts 122 of the first frame 102 to which it is closest and to which it is about perpendicular, alternatively essentially parallel, alternatively parallel, and each of the at least three attachment struts 114 of the second frame 104 is paired with one of the at least three weight struts 122 of the second frame 104 to which it is closest and to which it is about perpendicular, alternatively essentially parallel, alternatively parallel.

Figure 4:
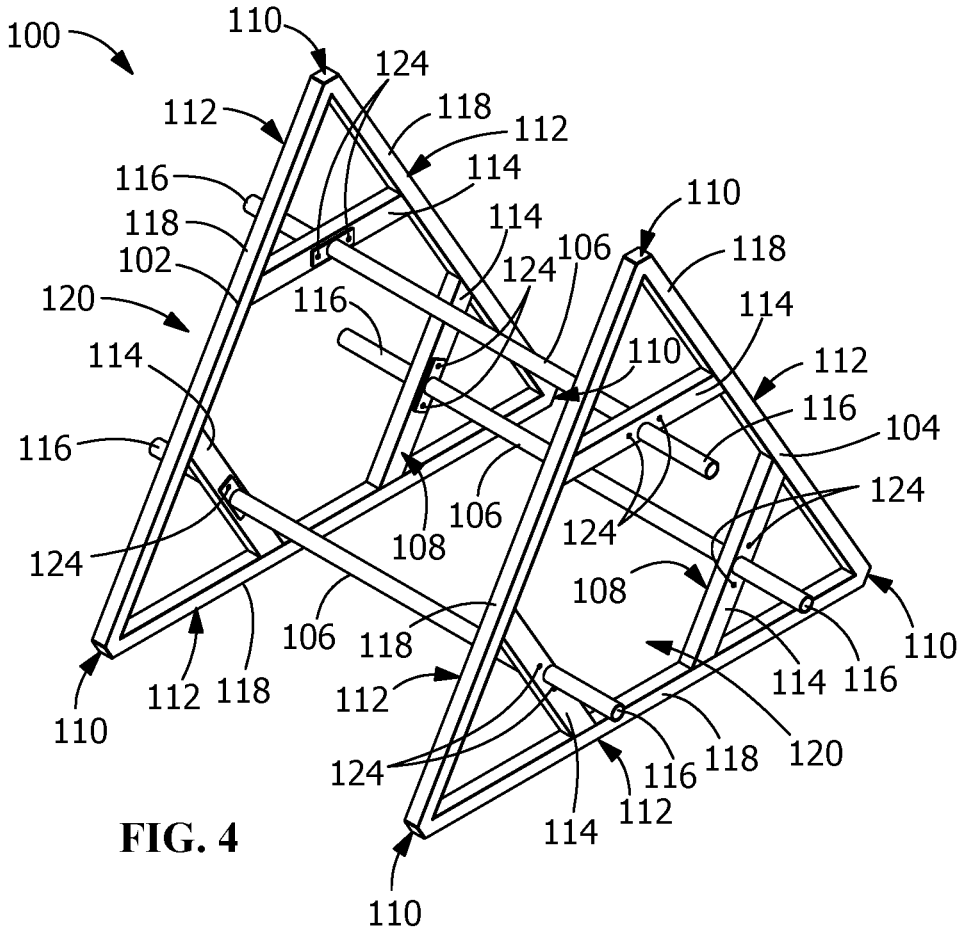
FIG. 4 is a perspective view of an exercise apparatus including aligned weight posts, according to an embodiment of the disclosure.
Figure 6:
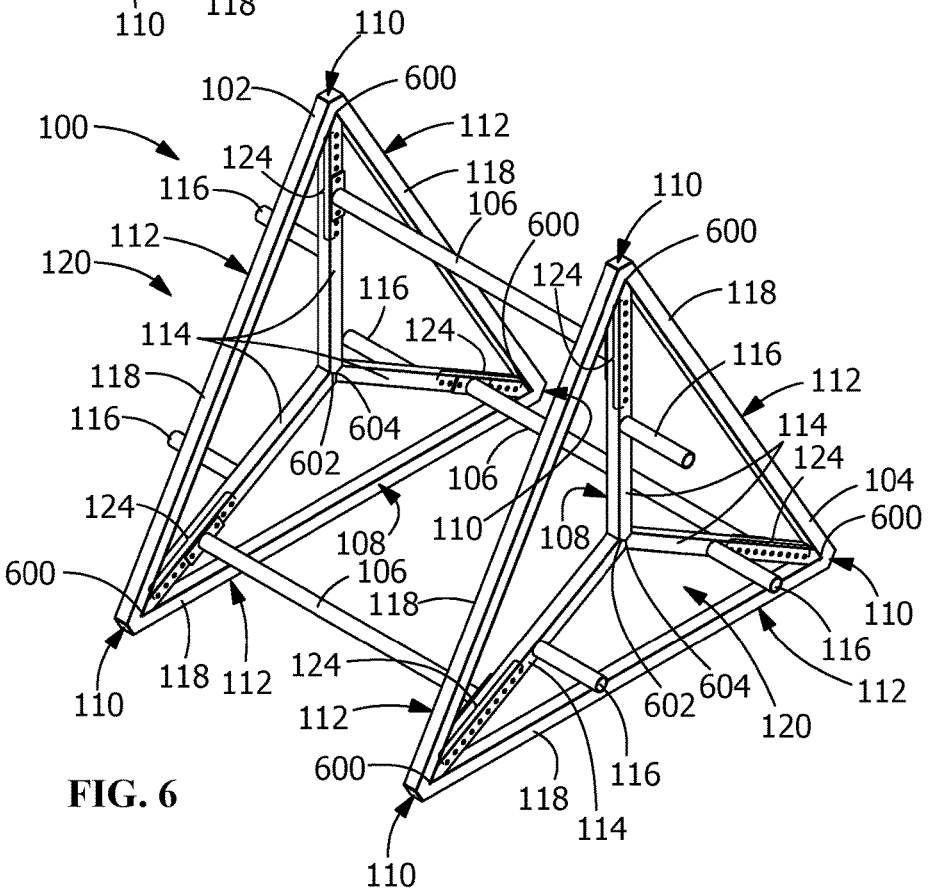
FIG. 6 is a perspective view of an exercise apparatus including adjustable crossbars, according to an embodiment of the disclosure.

In one embodiment (FIGS. 4 and 6), the at least three load posts 116 of the first frame 102 extend from the at least three attachment struts 114 of the first frame 102, and the at least three load posts 116 of the second frame 104 extend from the at least three attachment struts 114 of the second frame 104. Each of the at least three crossbars 106 may share its axis with one of the at least three load posts 116 of the first frame 102 and one of the at least three load posts 116 of the second frame 104 (FIG. 4), or of the at least three crossbars 106 may be axially displaced from the at least three load posts 116 of the first frame 102 and the at least three load posts 116 of the second frame 104 (FIG. 6).

Figure 5:
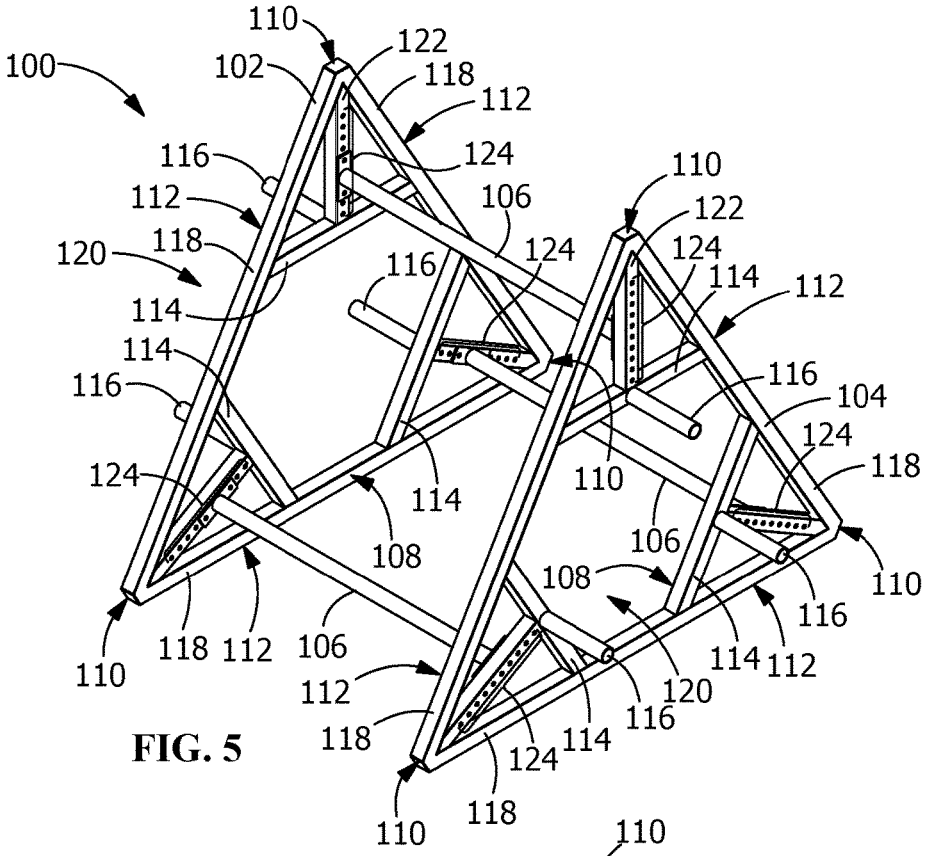
FIG. 5 is a perspective view of an exercise apparatus including adjustable crossbars, according to an embodiment of the disclosure.

The at least three crossbars 106 may be attached to the at least three attachment struts 114 of the first frame 102 and the at least three attachment struts 114 of the second frame 104 in any suitable manner, including, but not limited to, with fasteners 700 (FIG. 7) such as bolt and nut sets, by welding, but unitary formation through additive manufacturing or casting, or by combinations thereof. Referring to FIGS. 1-7, in one embodiment, each of the at least three crossbars 106 is releasably attached to one of the at least three attachment struts 114 of the first frame 102 and to one of the at least three attachment struts 114 of the second frame 104. Referring to FIGS. 5 and 6, each of the at least three attachment struts 114 of the first frame 102 and the at least three attachment struts 114 of the second frame 104 have a plurality of attachment points 124 for the at least three crossbars 106 disposed at different distances from one of the at least three vertices 110 which is nearest, such that the at least three crossbars 106 are adjustably positionable within the exercise apparatus 100.

Figure 7:
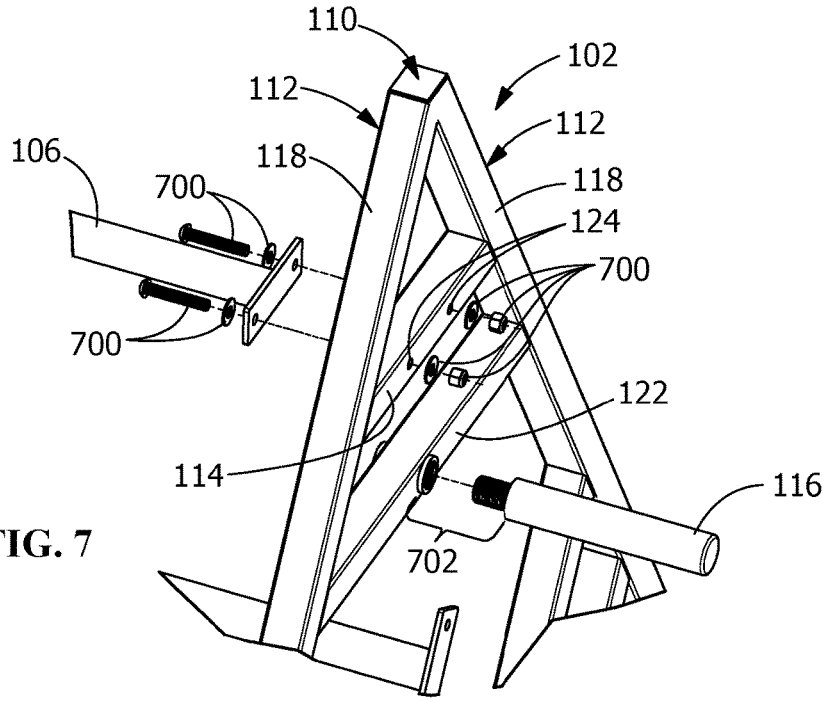
FIG. 7 is an exploded partial perspective view of an exercise apparatus, according to an embodiment of the disclosure.

The at least three load posts 116 of the first frame 102 and the at least three load posts 116 of the second frame 104 may be attached to the first frame 102 and the second frame 104, respectively, in any suitable manner, including, but not limited to, with fasteners such as bolt and nut sets, by welding, by unitary formation through additive manufacturing or casting, by threaded engagement 702, or by combinations thereof. Referring to FIG. 7, in one embodiment, each of the load posts 116 is releasably attached the first frame 102 or the second frame 104.

The exercise apparatus 100 may have any suitable number of sides 112, including, but not limited to, three sides 112 (FIGS. 1-6), four sides 112, five sides 112 (FIG. 8), and six sides 112.

Referring to FIGS. 1-6, in one embodiment, the first frame 102 is triangular, having three vertices 110 of the first frame 102, three sides 112 of the first frame 102 extending between the three vertices 110 of the first frame 102, the three sides 112 of the first frame 102 being formed of three frame struts 118 of the first frame 102, three attachment struts 114 of the first frame 102, and three load posts 116 of the first frame 102, and the second frame 104 is triangular, having three vertices 110 of the second frame 104, three sides 112 of the second frame 104 extending between the three vertices 110 of the second frame 104, the three sides 112 of the second frame 104 being formed of three frame struts 118 of the second frame 104, three attachment struts 114 of the second frame 104, and three load posts 116 of the second frame 104, and there are three crossbars 106 extending between the first frame 102 and the second frame 104, each of the three crossbars 106 attaching to one of the three attachment struts 114 of the first frame 102 and one of the three attachment struts 114 of the second frame 104.

Figure 8:
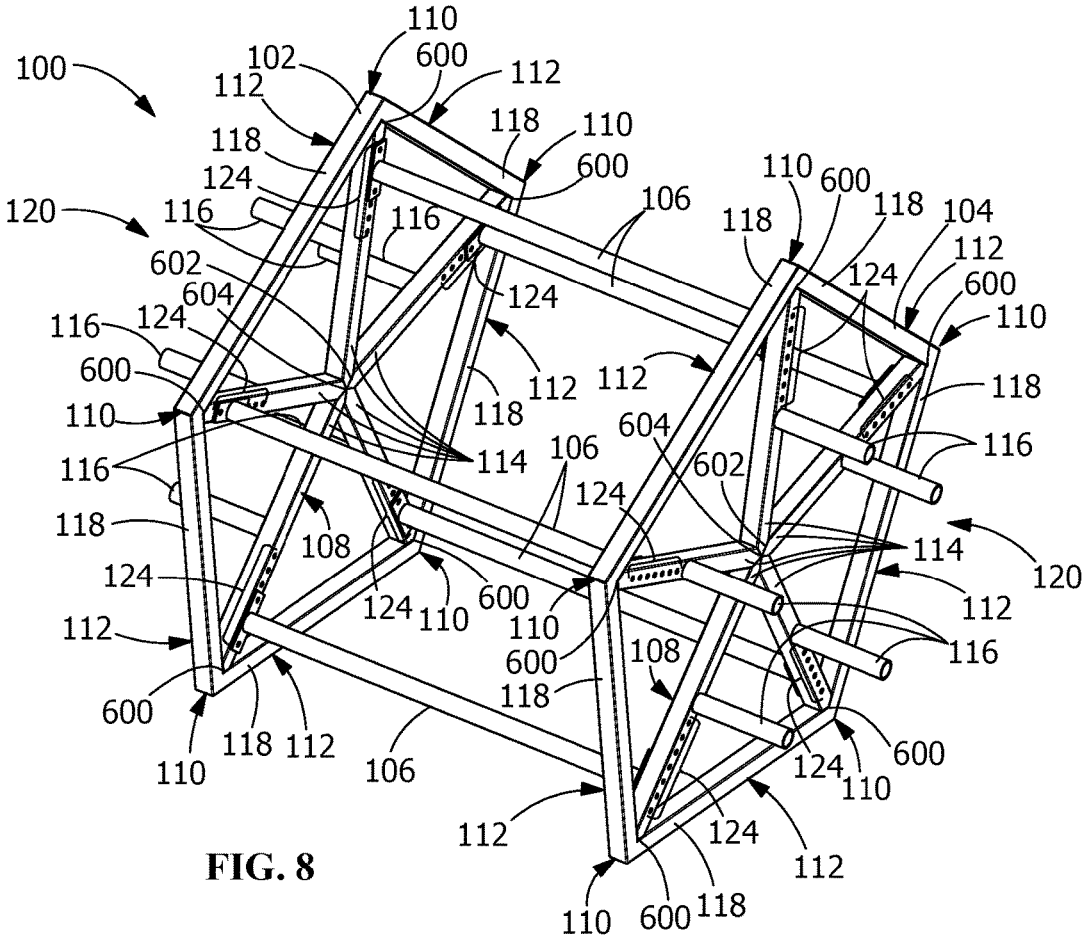
FIG. 8 is a perspective view of an exercise apparatus having five-sided frames, according to an embodiment of the disclosure.
Figure 9:
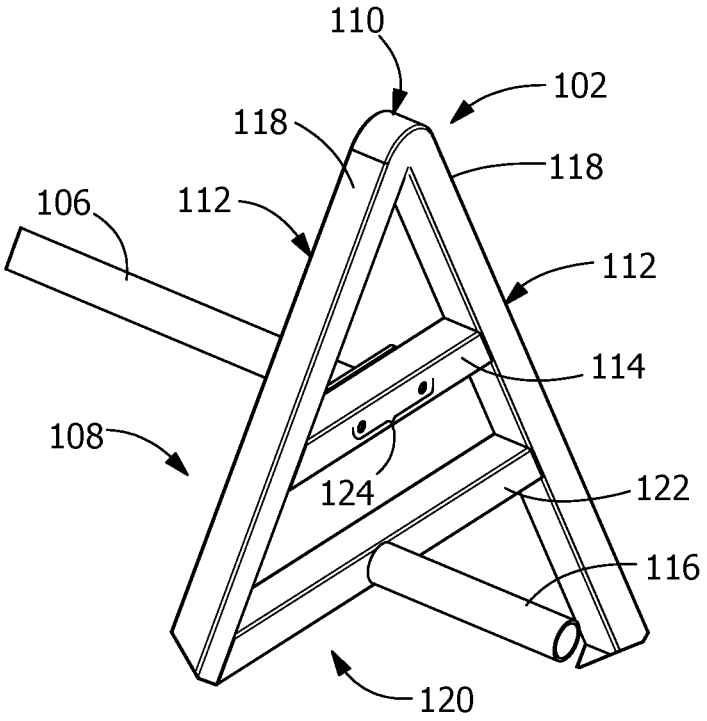
FIG. 9 is an expanded partial perspective view of an exercise apparatus having rounded vertices, according to an embodiment of the disclosure.

Referring to FIG. 8, in one embodiment, the first frame 102 is pentagonal, having five vertices 110 of the first frame 102, five sides 112 of the first frame 102 extending between the five vertices 110 of the first frame 102, the five sides 112 of the first frame 102 being formed of five frame struts 118 of the first frame 102, five attachment struts 114 of the first frame 102, and five load posts 116 of the first frame 102, and the second frame 104 is pentagonal, having five vertices 110 of the second frame 104, five sides 112 of the second frame 104 extending between the five vertices 110 of the second frame 104, the five sides 112 of the second frame 104 being formed of five frame struts 118 of the second frame 104, five attachment struts 114 of the second frame 104, and five load posts 116 of the second frame 104, and there are five crossbars 106 extending between the first frame 102 and the second frame 104, each of the five crossbars 106 attaching to one of the five attachment struts 114 of the first frame 102 and one of the five attachment struts 114 of the second frame 104.

Referring to FIGS. 1-4, in one embodiment, each of the three attachment struts 114 of the first frame 102 is attached to two of the three frame struts 118 of the first frame 102 and is adjacent a different vertex 110 of the three vertices 110 of the first frame 102, and each of the three attachment struts 114 of the second frame 104 is attached to two of the three frame struts 118 of the second frame 104 and is adjacent a different vertex 110 of the three vertices 110 of the second frame 104.

Referring to FIGS. 1-3, in a further embodiment, the first frame 102 further has three weight struts 122 of the first frame 102 and each of the three weight struts 122 of the first frame 102 is attached to two of the three frame struts 118 of the first frame 102 and is adjacent a different vertex 110 of the three vertices 110 of the first frame 102, the three weight struts 122 of the first frame 102 being disposed inward of the three attachment struts 114 of the first frame 102 and aligned about parallel, alternatively essentially parallel, alternatively parallel, with the three attachment struts 114 of the first frame 102, the second frame 104 further has three weight struts 122 of the second frame 104 and each of the three weight struts 122 of the second frame 104 is attached to two of the three frame struts 118 of the second frame 104 and is adjacent a different vertex 110 of the three vertices 110 of the second frame 104, the three weight struts 122 of the second frame 104 being disposed inward of the three attachment struts 114 of the second frame 104 and aligned about parallel, alternatively essentially parallel, alternatively parallel, with the three attachment struts 114 of the second frame 104, the at least three load posts 116 of the first frame 102 extend from the at least three weight struts 122 of the first frame 102, and the at least three load posts 116 of the second frame 104 extend from the at least three weight struts 122 of the second frame 104.

Referring to FIG. 5, in another embodiment, the first frame 102 further has three weight struts 122 of the first frame 102 and each of the three weight struts 122 of the first frame 102 is attached to two of the three frame struts 118 of the first frame 102 and is adjacent a different vertex 110 of the three vertices 110 of the first frame 102, and each of the three attachment struts 114 of the first frame 102 extends from one of the three weight struts 122 of the first frame 102 to the one of the three vertices 110 of the first frame 102 which is adjacent thereto, the second frame 104 further has three weight struts 122 of the second frame 104 and each of the three weight struts 122 of the second frame 104 is attached to two of the three frame struts 118 of the second frame 104 and is adjacent a different vertex 110 of the three vertices 110 of the second frame 104, and each of the three attachment struts 114 of the second frame 104 extends from one of the three weight struts 122 of the second frame 104 to the one of the three vertices 110 of the second frame 104 which is adjacent thereto, the at least three load posts 116 of the first frame 102 extend from the at least three weight struts 122 of the first frame 122, and the at least three load posts 116 of the second frame 104 extend from the at least three weight struts 122 of the second frame 104.

Referring to FIG. 6, in yet another embodiment, the three attachment struts 114 of the first frame 102 each include an outer end 600 which is attached to one of the three vertices 110 of the first frame 102, and an inner end 602, the inner ends 602 of each of the three attachment struts 114 of the first frame 102 being attached to one another at about a center 604 of the first frame 102, and the three attachment struts 114 of the second frame 104 each include an outer end 600 which is attached to one of the three vertices 110 of the second frame 104, and an inner end 602, the inner ends 602 of each of the three attachment struts 114 of the second frame 104 being attached to one another at about a center 604 of the second frame 104.

Figure 10:
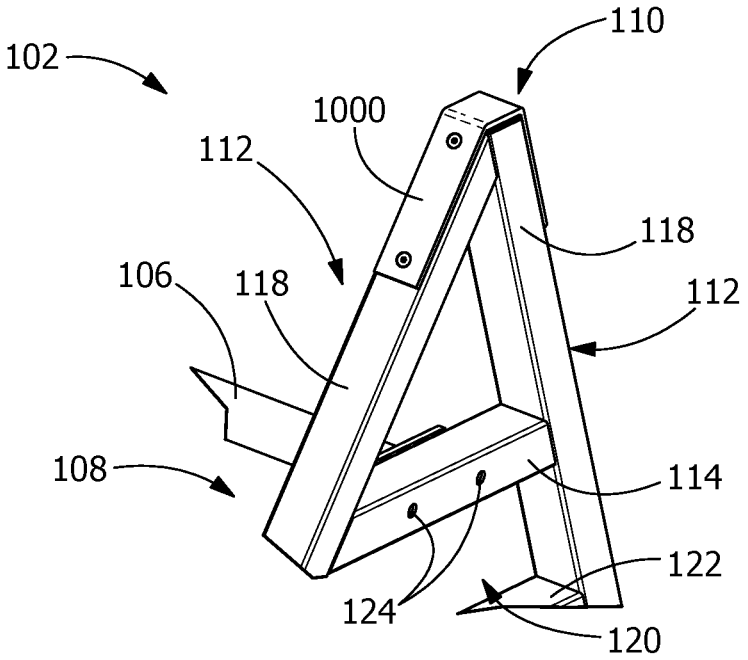
FIG. 10 is an expanded partial perspective view of an exercise apparatus including an elastic guard, according to an embodiment of the disclosure.

Referring to FIG. 10, in one embodiment, the exercise apparatus 100 includes elastic guards 1000 attached to the first frame 102 and the second frame 104 disposed over each of the at least three vertices 110 of the first frame 102 and each of the at least three vertices 110 of the second frame 104. The elastic guards 1000 may be affixed to the vertices 110 by any suitable attachment, including, but not limited to, riveting, bolting, adhesive attachment, and combinations thereof. The elastic guards 1000 may be formed from any suitable material, including, but not limited to, natural rubber, synthetic rubber, foam, elastomeric polymers, or combinations thereof.

Figure 11:
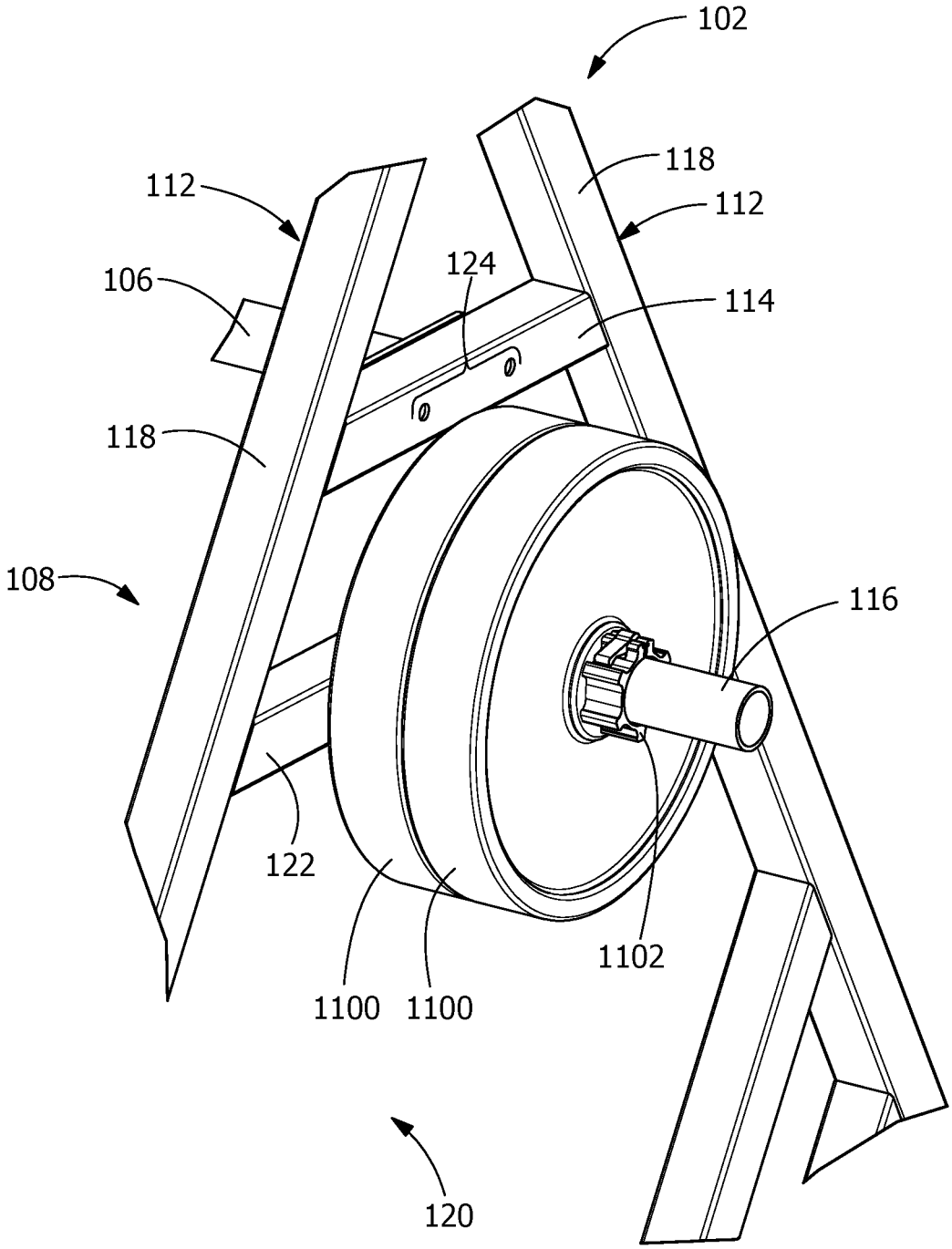
FIG. 11 is an expanded partial perspective view of an exercise apparatus including mounted weights, according to an embodiment of the disclosure.

Referring to FIG. 11, the at least three load posts 116 of the first frame 102 and the at least three load posts 116 of the second frame 104 are arranged and disposed to receive and releasably retain a plurality of weights 1100. The weights 1100 may be any suitable weights 1100, including, but not limited to, weight plates. The weights 1100 may be retained on the load posts 116 by any suitable retainer mechanism 1102, including, but not limited to clips, quicklee collars, spin-lock collars, clamp collars, screw-on collars, pressure collars, or combinations thereof.

Referring to FIGS. 1-11, the at least three sides 112 of the first frame 102 and the at least three sides 112 of the second frame 104 may be straight (shown) or may be curved (not shown). Suitable curves include, but are not limited to, concave curves, convex curves, and combinations thereof. The at least three vertices 110 of the first frame 102 and the at least three vertices 110 of the second frame 104 may come to a point (FIG. 8), may be flattened (FIGS. 1-7 and 10), may be rounded (FIG. 9), or combinations thereof.

The at least three frame struts 118 of the first frame 102, the at least three frame struts 118 of the second frame 104, the at least three attachment struts 114 of the first frame 102, the at least three attachment struts 114 of the second frame 104, the at least three load posts 116 of the first frame 102, the at least three load posts 116 of the second frame 104, the at least three weight posts 122 of the first frame 102, the at least three weight posts 122 of the second frame 104, and the at least three crossbars 106 may each, independently, have any suitable cross-sectional conformation. Suitable cross-sectional conformations include, but are not limited to, circular, elliptical, triangular, rounded triangular, square, rounded square, rectangular, rounded rectangular, pentagonal, rounded pentagonal, hexagonal, rounded hexagonal, and combinations thereof.

For purposes of a Zercher carry exercise, a user may grip one of the at least three crossbars 106 while standing within the exercise apparatus 100. The user crosses their arms underneath a crossbar 106, picks up the exercise apparatus 100, and then walks or carries the exercise apparatus 100. This exercise may strengthen the core muscle groups of the body. When a Zercher carry begins a non-inventive device may sway back and forth because of inertia. In one embodiment, the exercise apparatus 100 reduces or eliminates such swaying by locating the weight load closer to the body than in a non-inventive device.

For purposes of a yoke carry exercise, a user may load one of the at least three crossbars 106 onto the user's shoulders while standing within the exercise apparatus 100. The user stands underneath the exercise apparatus 100 so that a crossbar 106 of the exercise apparatus 100 lies across the upper back, similar to a squatting position. The user then grasps the crossbar 106 and presses or squats the exercise apparatus 100 to a fully standing position. The user then walks with the crossbar 106 across their shoulders. This exercise may strengthen the core muscle groups of the body. When a yoke carry begins a non-inventive device may sway back and forth because of inertia. In one embodiment, the exercise apparatus 100 reduces or eliminates such swaying by locating the weight load closer to the body than in a non-inventive device.

For purposes of a tire flip exercise, a user may grip one of the at least three crossbars 106 while standing outside the exercise apparatus 100. The exercise apparatus 100 may be loaded with weights 1100 in a symmetric or an asymmetric distribution mounted to the at least three load posts 116 of the first frame 102 and the at least three load posts 116 of the second frame 104. The user positions themselves with the crossbar 106 of the exercise apparatus 100 in front of them. The user then grabs the crossbar 106, preferably with a pronated grip, and picks up the exercise apparatus 100 in a deadlift type of motion. The user picks up the exercise apparatus 100 high enough to get underneath the exercise apparatus 100, and then uses a combination of upper body and lower body muscles to push the exercise apparatus 100 over, much like flipping a tractor tire. In one embodiment, an advantage of the exercise apparatus 100 over non-inventive devices is that the movement is very repeatable, because the grip is the same and body position is the same. Another advantage of the exercise apparatus 100 is the ability to adjust the number and weight of the plate weight such that the exercise apparatus 100 may be adjusted for use by person having different strength capabilities. Also, the added weight may be distributed asymmetrically such that the first flip is easiest, the second flip is more difficult, and the third flip is the most difficult.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed.

Those skilled in the art may readily adopt one or more of the inventive aspects, concepts and features into additional embodiments and uses within the scope of the general inventive concepts, even if such embodiments are not expressly disclosed herein. Additionally, even though some features, concepts and aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated.

Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. An exercise apparatus, comprising:

a first frame including:

at least three vertices of the first frame;

at least three sides of the first frame extending between the at least three vertices of the first frame, the at least three sides of the first frame being formed of at least three frame struts of the first frame;

at least three attachment struts of the first frame disposed inward from the at least three vertices of the first frame; and at least three load posts of the first frame extending from an outward face of the first frame;

a second frame aligned about parallel to the first frame, the second frame including:

at least three vertices of the second frame;

at least three sides of the second frame extending between the at least three vertices of the second frame, the at least three sides of the second frame being formed of at least three frame struts of the second frame;

at least three attachment struts of the second frame disposed inward from the at least three vertices of the second frame; and at least three load posts of the second frame extending from an outward face of the second frame; and at least three crossbars extending about orthogonally between an inward face of the first frame and an inward face of the second frame, and attaching to one of the at least three attachment struts of the first frame and one of the at least three attachment struts of the second frame, wherein the at least three load posts of the first frame and the at least three load posts of the second frame are arranged and disposed to receive and releasably retain a plurality of weights, and wherein the first frame is connected to the second frame only through the at least three crossbars.

2. The exercise apparatus of claim 1, wherein the at least three load posts of the first frame extend from the at least three attachment struts of the first frame, and the at least three load posts of the second frame extend from the at least three attachment struts of the second frame.

3. The exercise apparatus of claim 2, wherein each of the at least three crossbars shares the respective crossbar's axis with one of the at least three load posts of the first frame and one of the at least three load posts of the second frame.

4. The exercise apparatus of claim 1, wherein:

the first frame further includes at least three weight struts of the first frame;

the second frame further includes at least three weight struts of the second frame;

the at least three load posts of the first frame extend from the at least three weight struts of the first frame; and the at least three load posts of the second frame extend from the at least three weight struts of the second frame.

5. The exercise apparatus of claim 4, wherein the at least three weight struts of the first frame are disposed inward of the at least three attachment struts of the first frame, and the at least three weight struts of the second frame are disposed inward of the at least three attachment struts of the second frame.

6. The exercise apparatus of claim 4, wherein the at least three attachment struts of the first frame are disposed inward of the at least three weight struts of the first frame, and the at least three attachment struts of the second frame are disposed inward of the at least three weight struts of the second frame.

7. The exercise apparatus of claim 4, wherein each of the at least three attachment struts of the first frame is paired with one of the at least three weight struts of the first frame to which the respective attachment strut is closest and to which the respective attachment strut is about parallel, and each of the at least three attachment struts of the second frame is paired with one of the at least three weight struts of the second frame to which the respective attachment strut is closest and to which the respective attachment strut is about parallel.

8. The exercise apparatus of claim 4, wherein each of the at least three attachment struts of the first frame is paired with one of the at least three weight struts of the first frame to which the respective attachment strut is closest and to which the respective attachment strut is about perpendicular, and each of the at least three attachment struts of the second frame is paired with one of the at least three weight struts of the second frame to which the respective attachment strut is closest and to which the respective attachment strut is about perpendicular.

9. The exercise apparatus of claim 1, wherein each of the at least three crossbars is releasably attached to one of the at least three attachment struts of the first frame and to one of the at least three attachment struts of the second frame.

10. The exercise apparatus of claim 1, wherein each of the at least three attachment struts of the first frame and the at least three attachment struts of the second frame have a plurality of attachment points for the at least three crossbars disposed at different distances from one of the at least three vertices which is nearest, such that the at least three crossbars are adjustably positionable within the exercise apparatus.

11. The exercise apparatus of claim 1, wherein the at least three sides of the first frame and the at least three sides of the second frame are straight.

12. The exercise apparatus of claim 1, wherein the at least three sides of the first frame and the at least three sides of the second frame are curved.

13. The exercise apparatus of claim 1, wherein the at least three vertices of the first frame and the at least three vertices of the second frame are rounded.

14. The exercise apparatus of claim 1, further including elastic guards attached to the first frame and the second frame disposed over each of the at least three vertices of the first frame and each of the at least three vertices of the second frame.

15. The exercise apparatus of claim 1, wherein the at least three frame struts of the first frame, the at least three frame struts of the second frame, the at least three attachment struts of the first frame, the at least three attachment struts of the second frame, the at least three load posts of the first frame, and the at least three load posts of the second frame each have a cross-sectional conformation selected from the group consisting of circular, elliptical, triangular, rounded triangular, square, rounded square, rectangular, rounded rectangular, pentagonal, rounded pentagonal, hexagonal, rounded hexagonal, and combinations thereof.

16. An exercise apparatus, comprising:

a first triangular frame including:

three vertices of the first frame;

three sides of the first frame extending between the three vertices of the first frame, the three sides of the first frame being formed of three frame struts of the first frame;

three attachment struts of the first frame disposed inward from the three vertices of the first frame; and three load posts of the first frame extending from an outward face of the first frame;

a second triangular frame aligned about parallel to the first frame, the second frame including:

three vertices of the second frame;

three sides of the second frame extending between the three vertices of the second frame, the three sides of the second frame being formed of three frame struts of the second frame;

three attachment struts of the second frame disposed inward from the three vertices of the second frame; and three load posts of the second frame extending from an outward face of the second frame; and three crossbars extending about orthogonally between an inward face of the first frame and an inward face of the second frame, and attaching to one of the three attachment struts of the first frame and one of the three attachment struts of the second frame, wherein the three load posts of the first frame and the three load posts of the second frame are arranged and disposed to receive and releasably retain a plurality of weights.

17. The exercise apparatus of claim 16, wherein each of the three attachment struts of the first frame is attached to two of the three frame struts of the first frame and is adjacent a different vertex of the three vertices of the first frame, and each of the three attachment struts of the second frame is attached to two of the three frame struts of the second frame and is adjacent a different vertex of the three vertices of the second frame.

18. The exercise apparatus of claim 17, wherein:

the first frame further has three weight struts of the first frame and each of the three weight struts of the first frame is attached to two of the three frame struts of the first frame and is adjacent a different vertex of the three vertices of the first frame, the three weight struts of the first frame being disposed inward of the three attachment struts of the first frame and aligned about parallel with the three attachment struts of the first frame;

the second frame further has three weight struts of the second frame and each of the three weight struts of the second frame is attached to two of the three frame struts of the second frame and is adjacent a different vertex of the three vertices of the second frame, the three weight struts of the second frame being disposed inward of the three attachment struts of the second frame and aligned about parallel with the three attachment struts of the second frame;

the three load posts of the first frame extend from the three weight struts of the first frame; and the three load posts of the second frame extend from the three weight struts of the second frame.

19. The exercise apparatus of claim 16, wherein:

the first frame further has three weight struts of the first frame and each of the three weight struts of the first frame is attached to two of the three frame struts of the first frame and is adjacent a different vertex of the three vertices of the first frame, and each of the three attachment struts of the first frame extends from one of the three weight struts of the first frame to the one of the three vertices of the first frame which is adjacent thereto;

the second frame further has three weight struts of the second frame and each of the three weight struts of the second frame is attached to two of the three frame struts of the second frame and is adjacent a different vertex of the three vertices of the second frame, and each of the three attachment struts of the second frame extends from one of the three weight struts of the second frame to the one of the three vertices of the second frame which is adjacent thereto;

the three load posts of the first frame extend from the three weight struts of the first frame; and the three load posts of the second frame extend from the three weight struts of the second frame.

20. The exercise apparatus of claim 16, wherein the three attachment struts of the first frame each include an outer end which is attached to one of the three vertices of the first frame, and an inner end, the inner ends of each of the three attachment struts of the first frame being attached to one another at about a center of the first frame, and the three attachment struts of the second frame each include an outer end which is attached to one of the three vertices of the second frame, and an inner end, the inner ends of each of the three attachment struts of the second frame being attached to one another at about a center of the second frame.

* * * * *